US007790098B2

(12) United States Patent
Mochizuki

(10) Patent No.: US 7,790,098 B2
(45) Date of Patent: Sep. 7, 2010

(54) MOLTEN METAL HOLDING FURNACE

(75) Inventor: Syunji Mochizuki, Fujinomiya (JP)

(73) Assignee: Tounetsu Corporation, Shizuoka (JP)

( * ) Notice: Subject to any disclaimer, the term of this patent is extended or adjusted under 35 U.S.C. 154(b) by 199 days.

(21) Appl. No.: 11/791,534

(22) PCT Filed: Nov. 14, 2005

(86) PCT No.: PCT/JP2005/020844

§ 371 (c)(1),
(2), (4) Date: Mar. 28, 2008

(87) PCT Pub. No.: WO2006/057179

PCT Pub. Date: Jun. 1, 2006

(65) Prior Publication Data

US 2008/0303195 A1 Dec. 11, 2008

(30) Foreign Application Priority Data

Nov. 25, 2004 (JP) ..... 2004-340866
Apr. 18, 2005 (JP) ..... 2005-119883

(51) Int. Cl.
*C21B 7/24* (2006.01)
*C21D 11/00* (2006.01)

(52) U.S. Cl. ..... 266/80; 266/78; 266/89

(58) Field of Classification Search ..... 266/78, 266/80, 89
See application file for complete search history.

(56) References Cited

U.S. PATENT DOCUMENTS

2006/0214338 A1 9/2006 Hauser

FOREIGN PATENT DOCUMENTS

| | | |
|---|---|---|
| EP | 0 627 274 | 12/1994 |
| EP | 0 846 509 | 6/1998 |
| JP | 8-117948 | 5/1996 |
| JP | 3392544 | 5/1996 |
| JP | 8-150460 | 6/1996 |
| JP | 9-239510 | 9/1997 |

(Continued)

OTHER PUBLICATIONS

Supplementary European Search report issued Aug. 28, 2008 in connection with EP 05 80 6331.

(Continued)

*Primary Examiner*—Jessica L Ward
*Assistant Examiner*—Alexander Polyansky
(74) *Attorney, Agent, or Firm*—Wenderoth, Lind & Ponack, L.L.P.

(57) ABSTRACT

A molten metal holding furnace for supplying a constant quantity of the molten metal to a casting machine is composed of a holding chamber having a melt supply port, and a pressurization chamber having an upward melt outlet port. The holding chamber and the pressurization chamber are communicated with each other via an openable/closable first melt flow passage. The pressurization chamber is composed of a outlet section at which the melt outlet port is positioned and a pressurization section positioned on one side closer to the holding chamber. The holding chamber and the outlet section are juxtaposed with the pressurization section interposed therebetween, where the first melt flow passage is formed at a hearth of the pressurization section, and an openable/closable second melt flow passage communicating with the outlet section is formed at a hearth of the pressurization section.

4 Claims, 7 Drawing Sheets

FOREIGN PATENT DOCUMENTS

| | | | |
|---|---|---|---|
| JP | 11-138250 | | 5/1999 |
| JP | 3192623 | | 5/1999 |
| JP | 11-197816 | * | 7/1999 |
| JP | 11-245010 | | 9/1999 |
| JP | 2001-321914 | * | 11/2001 |
| JP | 2004-160507 | | 6/2004 |
| WO | 2004/089562 | | 10/2004 |

OTHER PUBLICATIONS

Chinese Office Action (along with English language translation) issued Sep. 19, 2008 in the Chinese Application No. 200580040536.5.

Japanese Office Action dated Oct. 13, 2009 in Application No. JP 2004-340866 (with translation).

Chinese Office Action dated Jan. 15, 2010 in Application No. 200580040536.5 (with translation).

* cited by examiner

MOLTEN METAL HOLDING FURNACE

BACKGROUND OF THE INVENTION

I. Technical Field

The present invention relates to a molten metal holding furnace for supplying a constant quantity of molten metal of nonferrous metal, such as aluminum and aluminum alloys to a casting machine.

II. Description of Related Art

Conventionally, there has been known a molten metal delivering apparatus for supplying a constant quantity of molten metal to a casting machine (see, e.g., JP 3192623 B).

JP 3192623 B discloses a molten metal delivering apparatus including: a melt storage furnace which has, in a hearth face thereof, a melt flow passage opening to be opened and closed by an up/down first cutoff valve; a supply chamber which is provided beside the melt storage furnace and which has a melt flow passage opening in a hearth face thereof and further which is formed so that its internal pressure can be increased and reduced; a fixed molten metal furnace which is provided beside the supply chamber and which has, in a hearth face thereof, a melt flow passage opening to be opened and closed by an up/down second cutoff valve, and further which has, at a side portion thereof, a delivery opening for supplying a constant quantity of molten metal to a casting machine, and a communicating pipe which makes the melt storage furnace, the supply chamber and the fixed molten metal furnace communicated at their respective melt flow passage openings to one another.

For supply of the molten metal in the melt storage furnace into the fixed molten metal furnace, first, the melt flow passage opening of the melt storage furnace is opened, and the melt flow passage opening of the fixed molten metal furnace is closed. In this case, the internal pressure of the supply chamber is reduced, so that the molten metal is supplied from the melt storage furnace to the supply chamber via the communicating pipe. Subsequently, the melt flow passage opening of the melt storage furnace is closed, and the melt flow passage opening of the fixed molten metal furnace is opened. In this case, the internal pressure of the supply chamber is increased, by which the molten metal is supplied from the supply chamber to the fixed molten metal furnace via the communicating pipe.

In the case of the molten metal delivering apparatus described in JP 3192623 A, the communicating pipe is provided for making the melt storage furnace, the supply chamber and the fixed molten metal furnace communicated at their hearths to one another, so that impurities such as oxide contained in the molten metal are more easily deposited within the communicating pipe for structural reasons. Therefore, during long-term operations, it may occur that the communicating pipe is blocked by deposited impurities, obstructing a smooth flow of the molten metal. There is a further problem that the impurities may flow into the fixed molten metal furnace along with the molten metal, making it impossible to ensure a clean molten metal to be supplied to the casting machine. In the case of this molten metal delivering apparatus, since decreases of the molten metal temperature in the communicating pipe and the supply chamber are inevitable, it becomes more difficult to supply molten metal of a constant temperature to the casting machine, thus, involving another problem of controlling the molten metal temperature in the fixed molten metal furnace. Still more, there is a need for a space to be formed above the melt surface in the fixed molten metal furnace, which causes a problem that this space incurs oxidation of the molten metal.

Various holding furnaces for casting use are also conventionally known (see, e.g., JP H11-138250 A, JP 3392544 A).

JP H11-138250 A discloses a casting-use holding furnace which is composed of a holding chamber and a pressurization chamber and which has a cutoff valve for opening and closing a melt flow passage opening located in the holding chamber, the pressurization being divided into a pressurization section for causing a pressurizing gas to apply a pressure onto a top surface of the molten metal, and a melt outlet section for causing the molten metal into a cavity of a metal mold. This casting-use holding furnace has a multilayered lining structure composed of a shell, a heat-insulating layer, a fireproof layer and a melt housing container, as listed from outside toward inside, where the melt housing container is formed into an integral bath as an alumina-base castable refractory.

JP 3392544 B discloses a casting-use holding furnace in which at a valve seat placement portion formed at an opening peripheral portion of the melt flow passage opening on one side closer to the holding chamber, a valve seat formed as a member independent of the above-mentioned holding chamber is provided so that its top surface becomes flush with an inner peripheral surface of the melt housing container, in which arrangement of the melt flow passage opening is opened and closed by bringing a tip of the cutoff valve into or out of contact with the valve seat.

In the case of the casting-use holding furnace described in JP H11-138250 A, since the castable refractory, which forms the integral bath of the melt housing container that makes direct contact with the molten metal has gas permeability, permeation of the molten metal into the castable refractory is unavoidable during repetitions of casting process, so that the permeation causes cracks or damage to occur in the castable refractory. In particular, occurrence of such cracks or damage in the pressurization section or the melt outlet section may obstruct the casting work as a problem. More specifically, as a result of occurrence of cracks or damage in the pressurization section, pressure control that has a direct influence on the casting work becomes unstable, making it impossible to implement stable continuous operation, and in the worst case, resulting in a shutdown of operation. Besides, such cracks or damage may incur leakage of the pressurization gas to the outside, causing accuracy of the pressure control to lower. Meanwhile, with occurrence of cracks or damage in the melt outlet section, whereas the control pressure in the pressurization section is maintained regular, a specified amount of molten metal is not be changed into the cavity of the metal mold, so that the cast article results in a defective product. Besides, since the molten metal sticks more and more on inner wall surfaces of the pressurization section and the melt outlet section, there arises a need for regularly removing sticking matters on the inner wall surfaces. However, because, of fragility of the castable refractory, it is highly likely that the surfaces of the castable refractory may be damaged during the removal work for the sticking matters, as a problem.

In the case of the casting-use holding furnace described in JP 3392544 B, since the top surface of the valve seat and the inner peripheral surface of the melt housing container are flush with each other, impurities generated in the melt holding chamber, especially deposits around the melt flow passage opening may flow into the pressurization chamber, contaminating the molten metal as a problem.

SUMMARY OF THE INVENTION

Accordingly, the present invention, having been accomplished to solve the above-described problems, has an object of providing a molten metal holding furnace which makes it possible to ensure a stable supply of a constant quantity of molten metal by maintaining a smooth flow of molten metal as well as maintaining a successful pressure control for the molten metal, and to ensure molten metal of cleanness and proper temperature free from any contamination by impurities, and moreover which allows size reduction as well as maintenance and inspection to be achieved more easily.

In order to achieve the above object, according to a first embodiment of the present invention, there is provided a molten metal holding furnace for supplying a constant quantity of the molten metal to a casting machine, comprising:

a holding chamber having a melt supply port; and a pressurization chamber having an upward melt outlet port, the holding chamber and the pressurization chamber being communicated with each other via an openable/closable first melt flow passage, wherein the pressurization chamber is composed of a outlet section at which the melt outlet port is positioned and a pressurization section positioned on one side closer to the holding chamber with respect to the outlet section, the pressurization section including level detection means for detecting an upper-limit level and a lower-limit level of molten metal in the pressurization section, and a gas flow passage which communicates with an upper space within the pressurization section, tube heaters placed in the holding chamber and the outlet section of the pressurization chamber, respectively, as they are immersed in their molten metal, the holding chamber and the outlet section are juxtaposed with the pressurization section interposed therebetween so as to be partitioned by a partition wall which is provided at a lower portion of the furnace and an upper end face of which forms a central hearth of the pressurization section at a position higher than a hearth face of the holding chamber, where the first melt flow passage is formed at a hearth of the pressurization section, and an openable/closable second melt flow passage communicating with the outlet section is formed at a hearth of the pressurization section, and wherein the molten metal in the holding chamber is introduced to the upper-limit level of the pressurization section via the first melt flow passage under a condition that the second melt flow passage is closed, thereafter a pressurization gas is supplied through the gas flow passage under conditions that the first melt flow passage is closed and that the second melt flow passage is opened, so that the molten metal in the pressurization section is lowered to the lower-limit level of the pressurization section.

According to such arrangement, it becomes possible to ensure a stable supply of a constant quantity of molten metal by maintaining a smooth flow of the molten metal, to ensure clean molten metal free from contamination by impurities, and further to achieve a downsizing and facilitation of the maintenance and inspection.

In the molten metal holding furnace of the first aspect of the invention, the tube heaters may be placed in the molten metal within the pressurization section as they are immersed therein.

According to such arrangement, lowering of the molten metal temperature in the pressurization section can be avoided.

In the molten metal holding furnace of the first aspect of the invention, it is allowable that in the process of introducing the molten metal within the holding chamber to the upper-limit level of the pressurization section, the upper space of the pressurization section is reduced in pressure by evacuation via the gas flow passage under a condition that the first melt flow passage is opened and the second melt flow passage is closed.

According to such arrangement, the introduction of the molten metal to the pressurization section can be carried out promptly.

In the molten metal holding furnace of the first aspect of the invention, it is allowable that a lining member formed of a cylindrical-shaped integral burned product made of fine ceramics is provided so as to cover an inner wall or inner walls of the pressurization section and/or the outlet section which is or are formed of a castable refractory.

According to such arrangement, since cracks and damage of the inner wall surfaces of the pressurization section and/or the outlet section as well as damage of the inner wall surfaces during the removal work of deposits on the inner wall surfaces can be prevented, a successful accuracy of pressure control for the molten metal can be maintained so that a stable supply of a constant quantity of molten metal can be ensured and that the maintenance and inspection can be facilitated.

According to a second aspect of the invention, there is provided a molten metal holding furnace for supplying a constant quantity of the molten metal to a casting machine, having a multilayered lining structure with its inner wall formed of a castable refractory, and comprising:

a holding chamber having a melt supply port; and a pressurization chamber having an upward melt outlet port, the holding chamber and the pressurization chamber being communicated with each other via an openable/closable first melt flow passage, wherein the pressurization chamber is composed of a outlet section at which the melt outlet port is positioned and a pressurization section positioned on one side closer to the holding chamber, the pressurization section including level detection means for detecting an upper-limit level of molten metal in the pressurization section, and a gas flow passage which communicates with an upper space within the pressurization section, tube heaters are placed in the holding chamber and the outlet section of the pressurization chamber, respectively, as they are immersed in their molten metal, the pressurization section and the outlet section of the pressurization chamber are communicated with each other via a lower flow passage at their hearths, and a lining member or lining members formed of a cylindrical-shaped integral burned product made of fine ceramics is/are provided so as to an inner wall or inner walls of the pressurization section and/or the outlet section which is/are formed of a castable refractory, and wherein the molten metal in the holding chamber is introduced to the upper-limit level of the pressurization section via the first melt flow passage, thereafter a pressurization gas is supplied through the gas flow passage under a condition that the first melt flow passage is closed, so that the molten metal is lowered to the lower-limit level of the pressurization section.

According to such arrangement, since cracks and damage of the inner wall surfaces of the pressurization section and/or the outlet section as well as damage of the inner wall surfaces during the removal work of deposits on the inner wall surfaces can be prevented, a successful accuracy of pressure control for the molten metal can be maintained so that a stable supply of a constant quantity of molten metal can be ensured and that the maintenance and inspection can be facilitated.

In the molten metal holding furnace of the second aspect of the invention, a lower end of the lining member is equal to or lower than the lower-limit level of molten metal in the pressurization section and/or the outlet section.

According to such arrangement, cracks and damage of the inner wall surfaces of the pressurization section and/or the outlet section as well as damage of the inner wall surfaces during the removal work of deposits on the inner wall surfaces can be more surely prevented.

In the molten metal holding furnace of the second aspect of the invention, it is allowable that the first melt flow passage is formed at a hearth of the holding chamber, and a valve seat which forms an opening of the first melt flow passage facing the holding chamber has a lower portion thereof fixed to a valve seat placement portion of the first melt flow passage so that an upper end face thereof is higher in position than its surrounding hearth of the holding chamber.

According to such arrangement, since the valve seat is so positioned that its upper end face is higher in position than its surrounding hearth face of the holding chamber, inflow of deposits within the holding chamber into the pressurization chamber is inhibited, making it possible to ensure clean molten metal free from contamination by impurities.

As described above, according to the molten metal holding furnace of the invention, it becomes achievable to ensure a stable supply of a constant quantity of molten metal, to prevent contamination of molten metal in the pressurization chamber, and to facilitate a downsizing as well as maintenance and inspection.

BRIEF DESCRIPTION OF THE DRAWINGS

The present invention will further be described below with reference to the accompanying drawings in some of which like parts are designated by like reference numerals, in which.

DETAILED DESCRIPTION OF THE INVENTION

Figure 1:
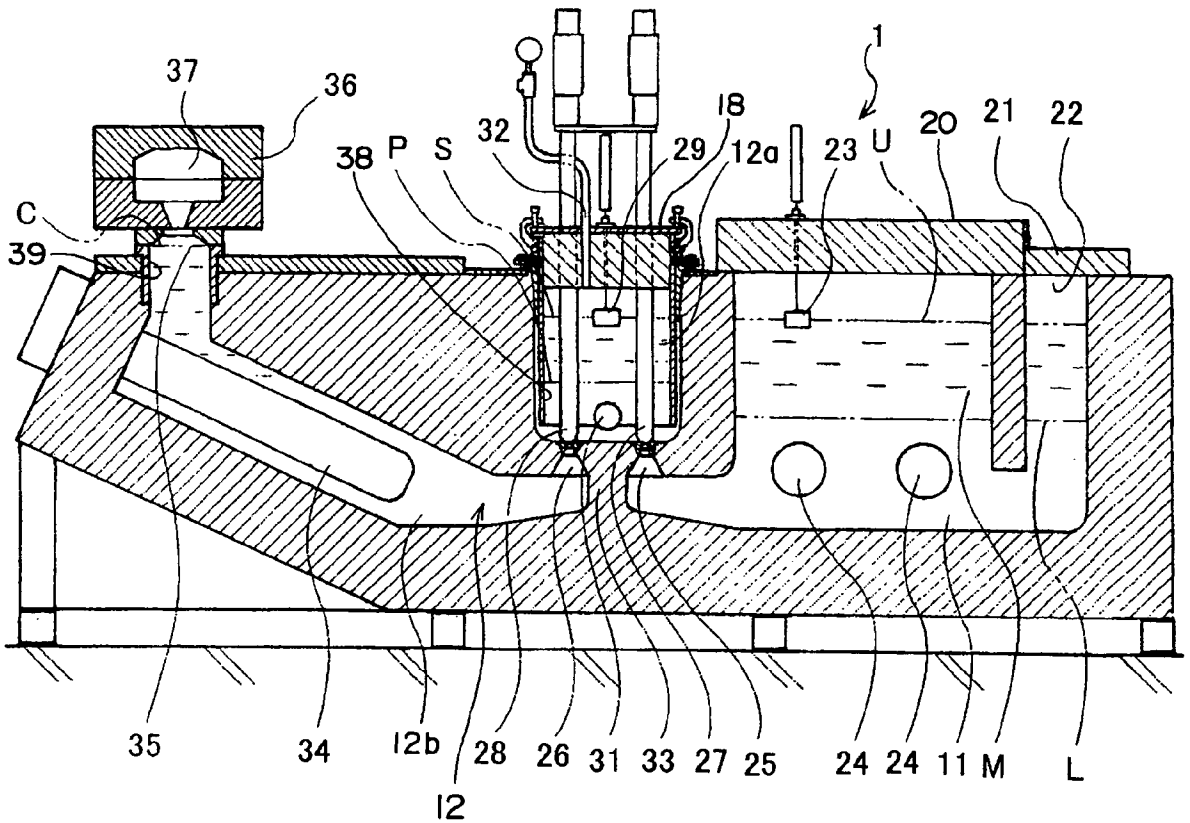
FIG. 1 is a sectional view of a molten metal holding furnace according to a first embodiment of the invention.

FIG. 1 shows a molten metal holding furnace 1 according to a first embodiment of the invention. The molten metal holding furnace 1 is composed of a holding chamber 11 and a pressurization chamber 12 which are placed in parallel with each other. The pressurization chamber 12 includes a pressurization section 12*a* and a outlet section 12*b*, where the pressurization section 12*a* and the outlet section 12*b* are provided as chambers independent of each other.

The holding chamber 11 includes a holding chamber lid 20 for covering an upward opening, and a melt supply port 22 to be opened and closed by an opening/closing lid 21 is provided. A surface level of a molten metal M within the holding chamber 11 is detected by a level sensor 23, and the molten metal of the holding chamber 11 can be held at a desired temperature by a tube heater 24. The tube heater 24 is placed as it is immersed in the molten metal of the holding chamber 11.

The pressurization section 12*a* has a first melt flow passage 25 communicating with a hearth of the holding chamber 11, and a second melt flow passage 26 communicating with a hearth of the outlet section 12*b*. The first melt flow passage 25 is positioned upper than the hearth face of the holding chamber 11, while the second melt flow passage 26 is upper than the hearth face of the outlet section 12*b*. Then, the first melt flow passage 25 is opened and closed by an up/down movable first cutoff valve 27, while the second melt flow passage 26 is opened and closed by an up/down movable second cutoff valve 28. An upper-limit surface level S and a lower-limit surface level P of the molten metal M within the pressurization section 12*a* are detected by a level sensor (level detection means) 29, and the molten metal of the pressurization section 12*a* can be held at a desired temperature by a tube heater 31. The tube heater 31 is placed as it is immersed in the molten metal of the pressurization section 12*a*. Further, a gas flow passage 32 connected to a pressure increasing/reducing device (not shown) is provided so as to communicate with a top sealing lid 18 of the pressurization section 12*a* so that the internal pressure of the pressurization section 12*a* can be increased or reduced.

The outlet section 12*b* is separated from the holding chamber 11 by a partition wall 33 which is provided at a lower portion of the molten metal holding furnace 1 and the upper end face of which forms a central hearth of the pressurization section 12*a*, and the outlet section 12*b* is communicatable with the holding chamber 11 only via the pressurization section 12*a*. The outlet section 12*b* is so inclined as to become increasingly higher with increasing distance from the lower bottom face of the second melt flow passage 26. In the inclined portion, a tube heater 34 for keeping the molten metal of the outlet section 12*b* at a desired temperature is provided as it is immersed in the molten metal, and a melt outlet port 35 that opens upward is formed at an end portion located at an uppermost position. Further, a metal mold 36 is fixed above the melt outlet port 35, and a cavity 37 within the metal mold 36 communicates with the melt outlet port 35.

Inner wall surfaces of the pressurization section 12*a* and the melt outlet port 35 of the outlet section 12*b*, respectively, are formed of lining members 38, 39 which are formed of cylindrical-shaped integral burned products of fine ceramics (e.g., silicon nitride) which are provided so as to cover the wall surfaces made of a refractory. Its effects will be described on a later-described fourth embodiment.

Next, an operating method for the molten metal holding furnace 1 having the above-described construction will be explained. First, the opening/closing lid 21 is rotated, causing the melt supply port 22 to be opened, and the molten metal M is supplied from the melt supply port 22. Then, the opening/closing of the first melt flow passage 25, the opening/closing of the second melt flow passage 26, and the pressurization/depressurization of the pressurization section 12*a* are carried out, thereby obtaining an initial state that the molten metal M in the holding chamber 11 is held at an upper-limit level U, the molten metal M in the pressurization section 12*a* is held at a suction termination level S, which is an upper-limit melt surface level, and the molten metal M in the outlet section 12*b* is held at a specified surface level C. Thereafter, the first melt flow passage 25, the second melt flow passage 26 and the melt supply port 22 are closed.

With the metal mold 36 integrated above the melt outlet port 35, the second melt flow passage 26 is opened by an upstroke of the second cutoff valve 28, while the pressurization section 12*a* is pressurized by a pressurization gas coming up along the gas flow passage 32. As a result of this, the molten metal M in the pressurization section 12*a* flows into the outlet section 12*b* through the second melt flow passage 26, so that the molten metal in the outlet section 12*b* starts to be charged into the cavity 37 through the melt outlet port 35.

Through lowering of the melt surface level in the pressurization section 12*a*, when a reach of the melt surface to a pressurization termination level P, which is the lower-limit melt surface level, is detected by the level sensor 29, the charging of the molten metal into the cavity 37 is completed. Further, after the charging state of the molten metal has been maintained for a specified time elapse, the supply of the pressurization gas from the gas flow passage 32 is stopped, followed by a reduction of the pressure in the pressurization section 12*a* to atmospheric pressure, where the second melt flow passage 26 is closed by a downstroke of the second cutoff valve 28. Then, after a specified time elapse, the metal mold 36 is opened, the cast article is taken out, and thereafter the metal mold 36 is closed again so as to be integrated together.

When the second melt flow passage 26 is closed, the first cutoff valve 27 is moved up, causing the first melt flow passage 25 to be opened, so that the pressurization section 12*a* and the holding chamber 11 are communicated with each other. Currently with this, evacuation through the gas flow passage 32 is started, by which the pressurization section 12*a* is depressurized. As a result, the molten metal of the holding chamber 11 flows into the pressurization section 12*a* via the first melt flow passage 25.

Through elevation of the melt surface level in the pressurization section 12*a*, when a reach of the melt surface to the suction termination level S is detected by the level sensor 29, the first cutoff valve 27 is moved down, causing the first melt flow passage 25 to be closed as well as the evacuation through the gas flow passage 32 to be stopped.

This is a completion of 1 shot, and from this on, the above-described operations are repeated. Meanwhile, through lowering of the melt surface level in the holding chamber 11, when a reach thereof to the lower-limit level L is detected by the level sensor 23, the operator is informed of that by means that are not shown. Then, the molten metal is resupplied from the melt supply port 22 until a reach of the melt surface level to the upper-limit level U is detected by the level sensor 23.

As shown above, in the molten metal holding furnace 1, the first melt flow passage 25 of the pressurization section 12*a* is formed so as to be higher than the hearth face of the holding chamber 11, and the holding chamber 11 and the outlet section 12*b* are separated from each other by the partition wall 33 and communicatable with each other only via the first melt flow passage 25 of the pressurization section 12*a* and the second melt flow passage 26. As a result, impurities deposited on the hearth of the holding chamber 11 can be inhibited from flowing into the outlet section 12*b*, making it possible to supply clean molten metal free from contamination by impurities, so that there occurs no blocking of flow passage due to impurities and a smooth flow of the molten metal can be ensured.

Furthermore, in the molten metal holding furnace 1, the outlet section 12*b* is inclined so as to be directed upward from the first melt flow passage 26 toward the melt outlet port 35, so that the blocking of the inflow of the impurities into the cavity 37 can be ensured, allowing the molten metal in the cavity 37 to be kept clean at all times and thus prevented from oxidation. Also, the holding chamber 11, the pressurization section 12*a* and the outlet section 12*b* are provided in parallel with one another and partitioned each by one wall so as to be communicable with one another without any intermediate interposition therebetween. Therefore, it becomes easier to downsize the molten metal holding furnace 1 and to facilitate its maintenance and inspection. Further, with the tube heater 24 placed in the pressurization section 12*a*, it becomes achievable to improve the accuracy of the molten metal temperature in the pressurization section 12*a*.

Figure 2:
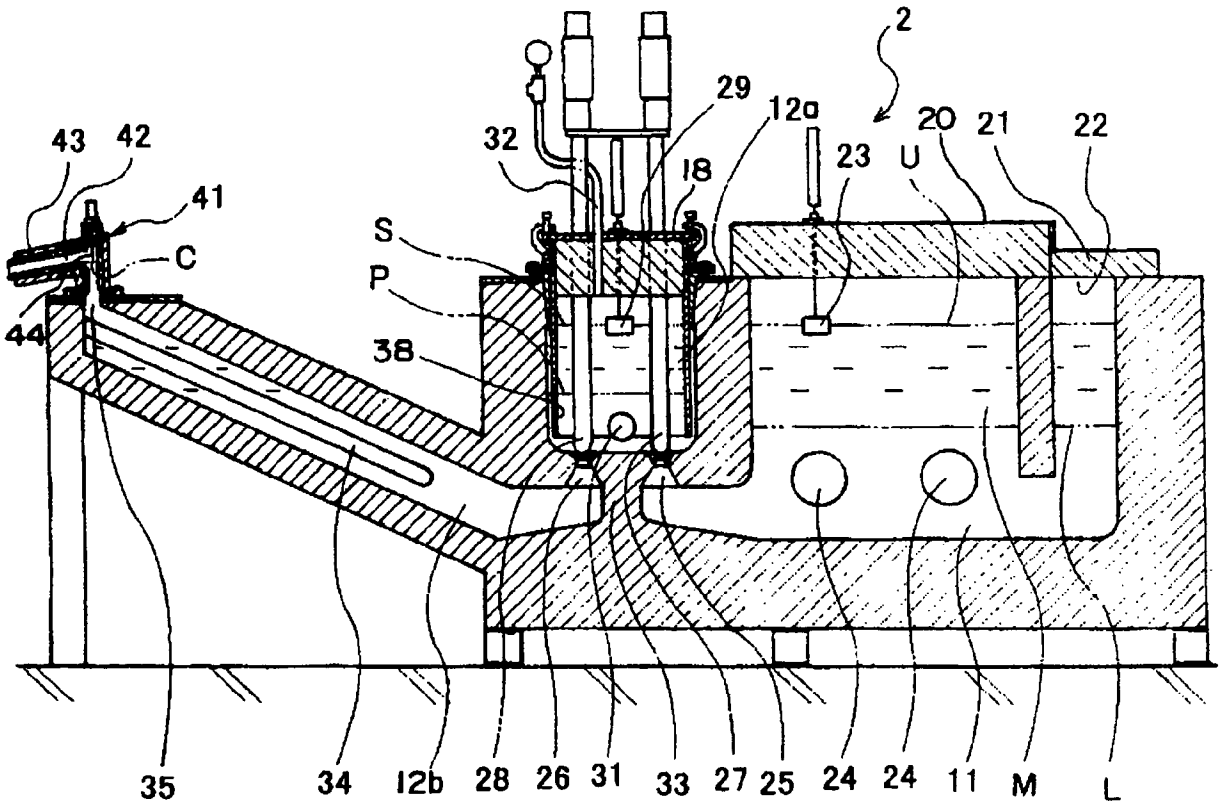
FIG. 2 is a sectional view of a molten metal holding furnace according to a second embodiment of the invention.

FIG. 2 shows a molten metal holding furnace 2 according to a second embodiment of the invention. In this molten metal holding furnace 2, component parts in common to the molten metal holding furnace 1 shown in FIG. 1 are designated by like reference numerals and their description is omitted.

In the molten metal holding furnace 2, a delivering means 41 of an upper melt supply type is provided above the melt outlet port 35 instead of the metal mold 36. This delivering means 41 has a nozzle unit 43 that forms a melt flow passage 42 communicating with the melt outlet port 35 and bent in a dogleg shape, and an unshown casting machine is connected to a tip portion of the nozzle unit 43. The delivering means 41 is also equipped with a level sensor 44 so that a surface level C of the molten metal M can be detected in the melt flow passage 42. Further, the operating method described above applies to the molten metal holding furnace 2, except that through a downstroke of the molten metal level in the pressurization section 12*a*, when a reach of the melt surface to the pressurization termination level P is detected by the level sensor 29, the second cutoff valve 28 is moved down, causing the second melt flow passage 26 to be closed and causing the supply of pressurization gas from the gas flow passage 32 to be stopped.

Figure 3:
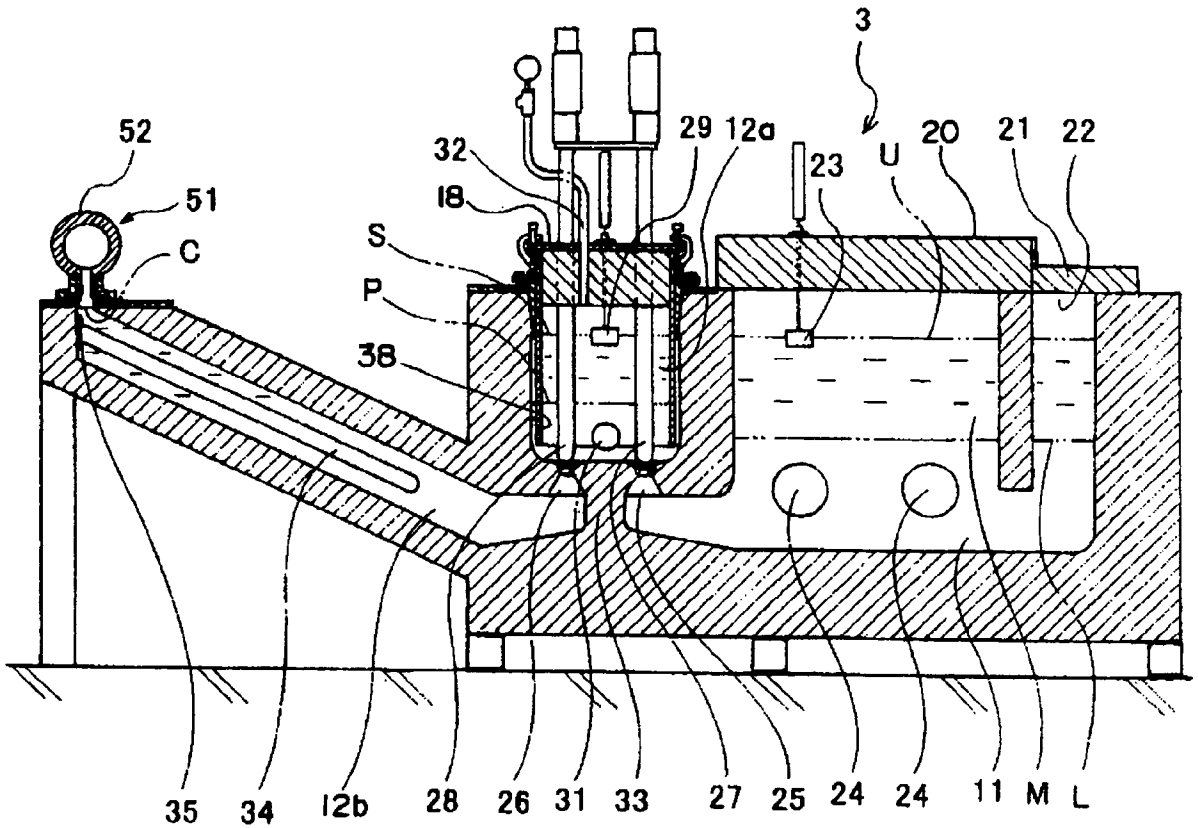
FIG. 3 is a sectional view of a molten metal holding furnace according to a third embodiment of the invention.

FIG. 3 shows a molten metal holding furnace 3 according to a third embodiment of the invention. In this molten metal holding furnace 3, component parts in common to the molten metal holding furnace 1 shown in FIG. 1 are designated by like reference numerals and their description is omitted.

In the molten metal holding furnace 3, a delivering means 51 of a lower melt supply type is provided above the melt outlet port 35 instead of the metal mold 36. This delivering means 51 is connected to a casting machine (not shown) behind-a cylindrical-shaped sleeve 52 as it is represented in FIG. 3, and further connected to an injection cylinder (not shown), which has an injection plunger that moves back and forth within the sleeve 52, in front as it is viewed in the drawing sheet. Then, with molten metal supplied from the melt outlet port 35 into the sleeve 52, the injection cylinder is activated, causing the injection plunger to advance to thrust the molten metal in the sleeve 52 toward the casting machine. Thus, the molten metal is charged into the cavity of the casting machine. Thereafter, the injection plunger retreats to the original position. Further, the operating method described above also applies to the molten metal holding furnace 3, except that through a downstroke of the molten metal level in the pressurization section 12*a*, when a reach of the melt surface to the pressurization termination level P is detected by the level sensor 29, the second cutoff valve 28 is moved down, causing the second melt flow passage 26 to be closed and causing the supply of pressurization gas from the gas flow passage 32 to be stopped.

In either case of the molten metal holding furnaces 2 and 3, as in the case of the molten metal holding furnace 1, it is implementable to block impurities deposited on the hearth of the holding chamber 11 from flowing into the outlet section 12*b*, to ensure a smooth flow of the molten metal, to maintain a clean state of the molten metal in the cavity 37 as a result of the blocking from flow of the impurities into the cavity 37, and to prevent oxidation of those impurities. Furthermore, as in the foregoing case, downsizing of the furnace as a whole as well as facilitation of its maintenance and inspection become easier to do, while it becomes achievable to improve the accuracy of the molten metal temperature in the pressurization section 12*a* by virtue of the placement of the immersion tube heater 24 in the pressurization section 12*a*.

FIGS. 4 to 7 show a molten metal holding furnace 4 according to a fourth embodiment of the invention. This molten metal holding furnace 4, having a multilayered lining structure as in the casting-use holding furnace disclosed in JP H11-138250 A described in conjunction with the background art, has an inner wall W formed of a castable refractory, and includes a holding chamber 11 and a pressurization chamber 12 which are placed in parallel with each other and which are communicated with each other at their hearths.

The holding chamber 11 includes a holding chamber lid 20 for covering an upward opening, and further includes a tube heater 24 and a temperature sensor 40 provided at side wall portions, respectively, of an inner wall made of a refractory, so that molten metal supplied from a melting furnace (not shown) and stored inside can be held within a specified temperature range. Also, the holding chamber 11 has, at a hearth thereof, a melt flow passage (first melt flow passage) 25 communicating with the pressurization chamber 12. At a valve seat placement portion 15 formed on an upper-end inner circumferential portion of the melt flow passage 25 is fixed a valve seat 16 which is a cylindrical-shaped integral burned product of fine ceramics (e.g., silicon nitride) which is so provided that its upper end face becomes higher in position than the hearth face of the holding chamber 11. Then, above the valve seat 16, a cutoff valve (first cutoff valve) 27 for opening and closing the melt flow passage 25 so as to hermetically and up/down movably extend through the holding chamber lid 20. That is, the cutoff valve 27 comes into close contact with the valve seat 16 in a downstroke to close the melt flow passage 25, and goes away from the valve seat 16 in an upstroke to open the melt flow passage 25.

The pressurization chamber 12 includes a pressurization section 12*a* and a outlet section 12*b*, which are communicated with each other at their hearths via a lower flow passage 17 communicating with the melt flow passage 25. The outlet section 12*b* has an upward melt outlet port 35. Also, the pressurization section 12*a* is positioned closer to the holding chamber 11 than the outlet section 12*b*.

At the inner walls W of the pressurization section 12*a* and the outlet section 12*b*, lining members 38, 39 formed of cylindrical-shaped integral burned products of fine ceramics (e.g., silicon nitride) are provided so as to cover the wall surfaces. A tube heater 34 is provided in the lower flow passage 17 of the pressurization chamber 12 as it is immersed in the molten metal, and a gas flow passage 32 is provided in a top sealing lid 18 of the pressurization section 12*a* while a level sensor (level detection means) 29 is hung from the top sealing lid 18. As a result, an upper space of the molten metal is pressurized, while a specified melt surface level S, which is an upper-limit melt surface level, of the molten metal in the pressurization section 12*a* is detected. Further, a metal mold 36 is fixed on a die base 45 fixed on top of the outlet section 12*b*, where the melt outlet port 35 and the cavity 37 of the metal mold 36 are communicated with each other via a melt pass hole 46 of the die base 45.

Figure 4:
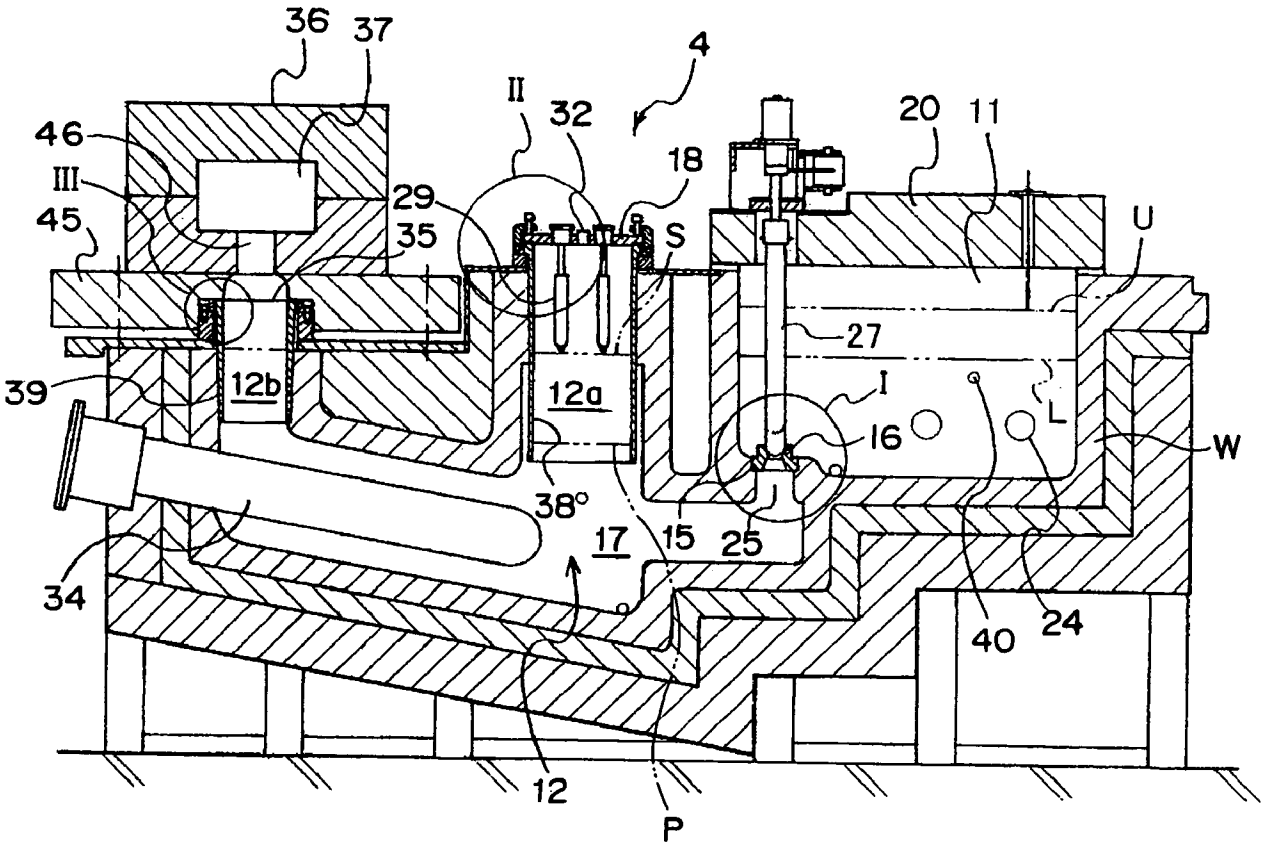
FIG. 4 is a sectional view of a molten metal holding furnace according to a fourth embodiment of the invention.
Figure 5:
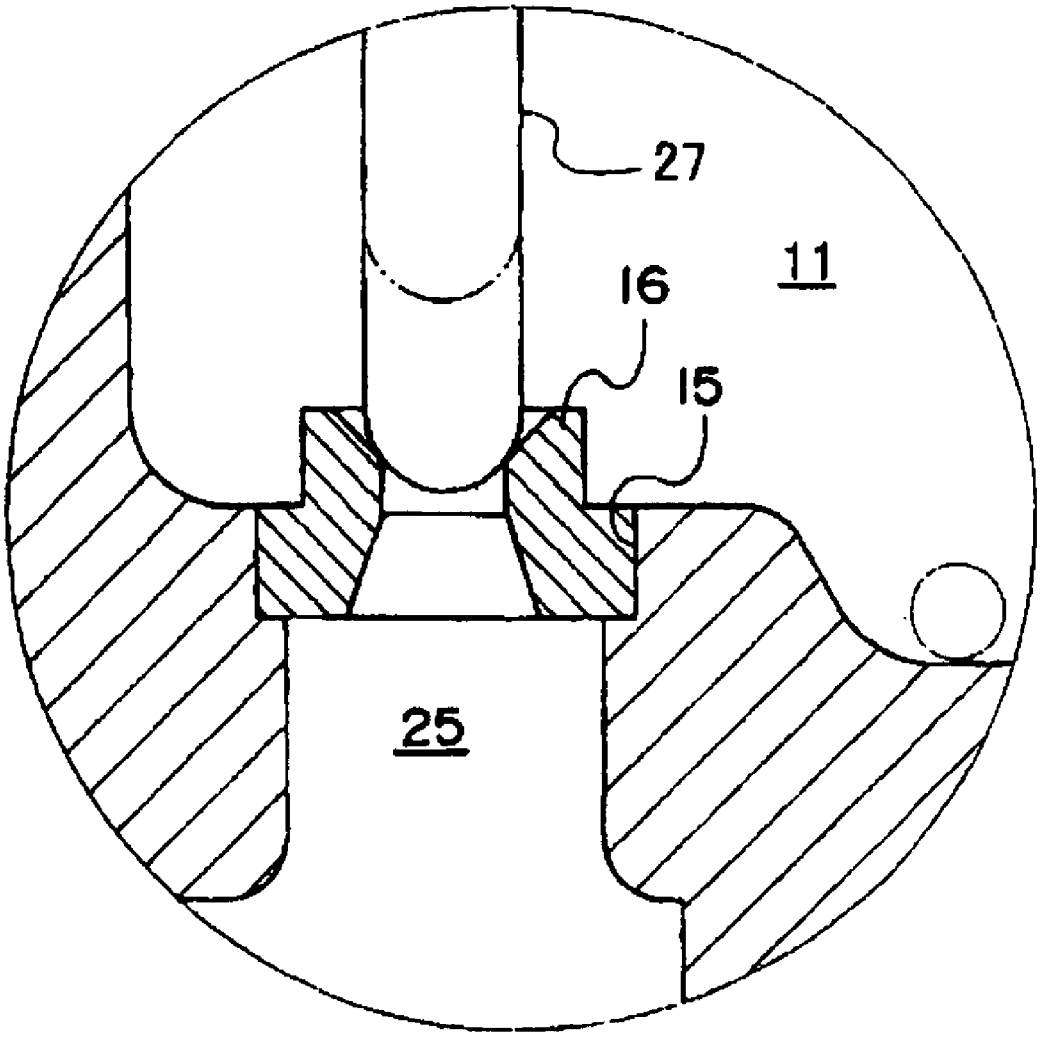
FIG. 5 is an enlarged view of a part encircled by circle I of FIG. 4.
Figure 6:
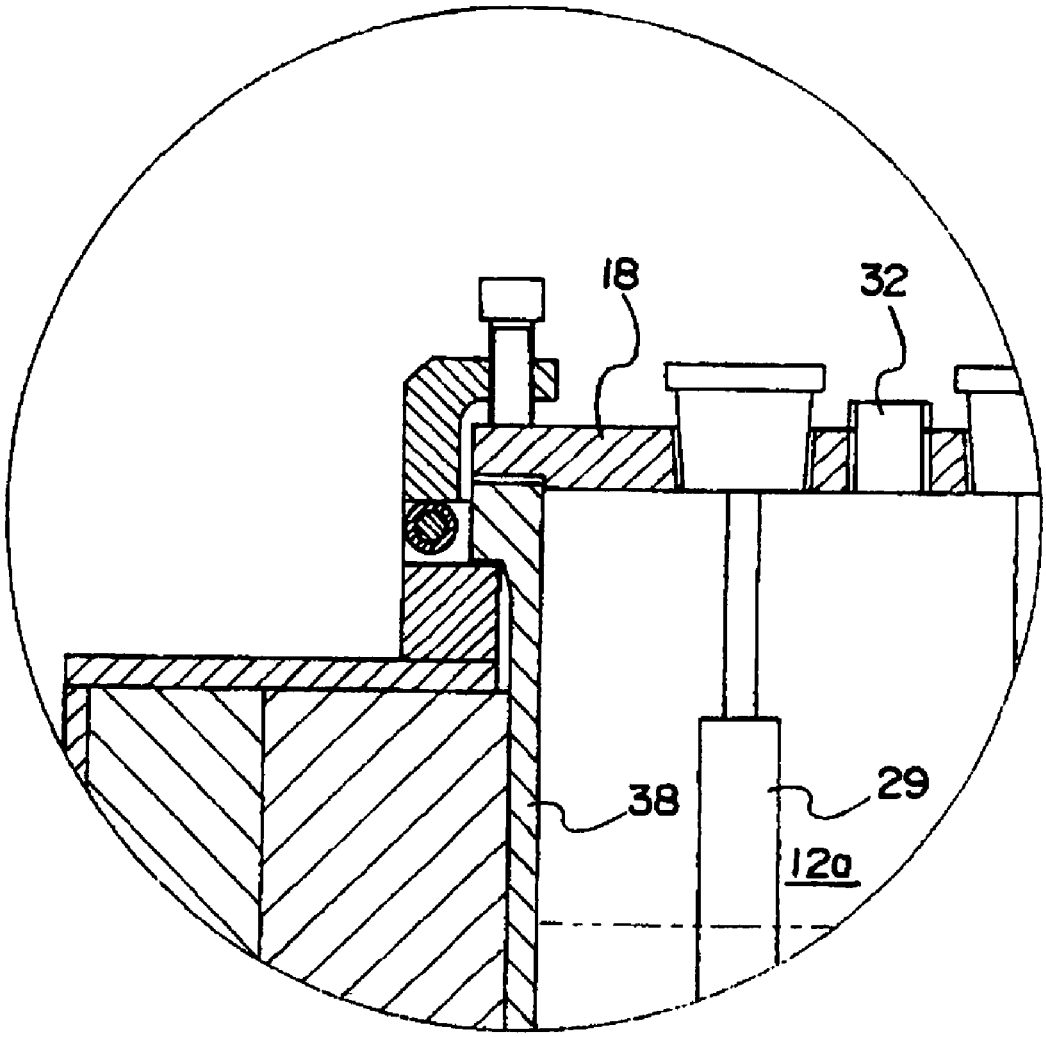
FIG. 6 is an enlarged view of a part encircled by circle II of FIG. 4.
Figure 7:
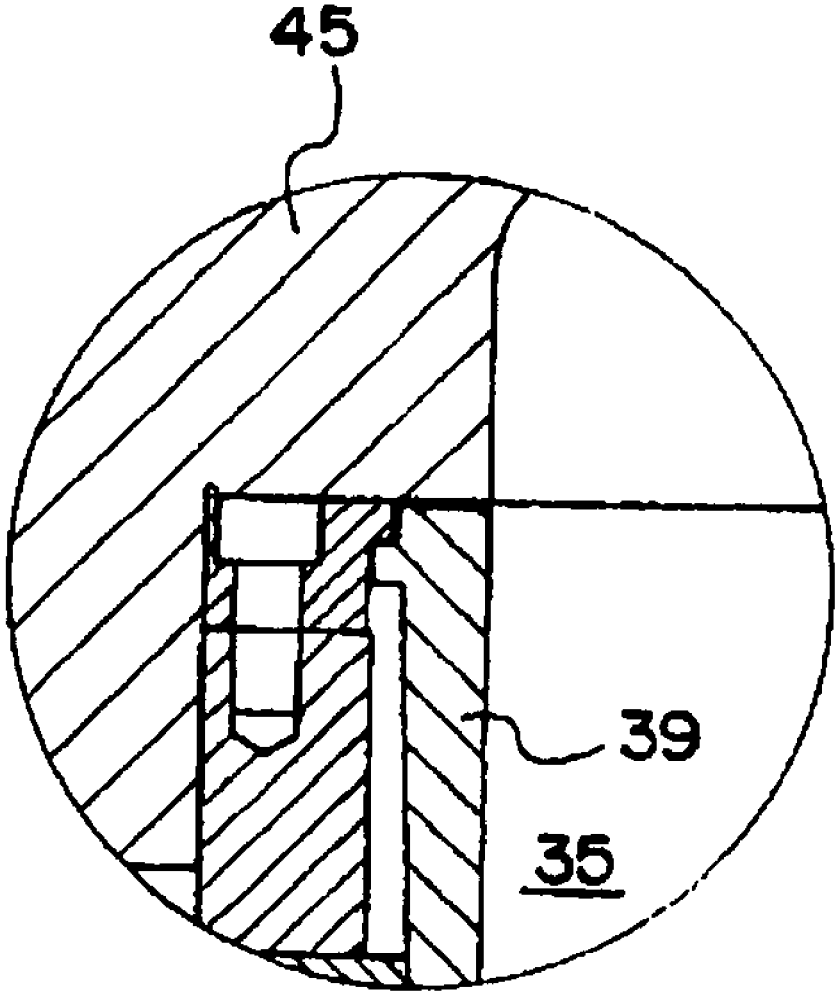
FIG. 7 is an enlarged view of a part encircled by circle III of FIG. 4.

In addition, in the holding chamber 11 of FIG. 4, a two-dot chain line U shows a upper-limit level of the melt surface, and a two-dot chain line L shows a lower-limit level of the melt surface.

In the molten metal holding furnace 4 having the construction described above, with the melt flow passage 25 closed, the molten metal in the pressurization chamber 12*a* is kept at a specified melt surface level S, while the melt surface level in the holding chamber 11 is keep between the above-mentioned two-dot chain lines U and L and moreover the molten metal is kept within a specified temperature range by the tube heaters 24 and 34. Then, the pressurization chamber 12*a* is pressurized by the pressurization gas (e.g., inert gas such as $N_2$, Ar) fed in from the gas flow passage 32, and as a result, the melt surface in the pressurization section 12*a* lowers while the melt surface in the outlet section 12*b* elevates, by which the molten metal starts to be charged into the cavity 37 via the melt pass hole 46. Upon completion of the charging of the molten metal into the cavity 37, the charging state of the molten metal is maintained for a specified time period. It is noted that at the time of completion of the charging of molten metal, the melt surface in the pressurization section 12*a* lowers from the specified melt surface level S to the lower-limit melt surface level P. Thereafter, the supply of the pressurization gas is stopped so that the internal pressure of the pressurization section 12*a* is reduced to the atmospheric pressure. This gives rise to a backflow of the molten metal in the outlet section 12*b*, causing the melt surface of the pressurization section 12*a* to elevate from the lower-limit melt surface level P to a specified position. Thereafter, the metal mold 36 is opened, and the cast article is taken out. After this casting work, the cutoff valve 27 goes up, causing the melt flow passage 25 to be opened, which lets the molten metal of the holding chamber 11 flow into the pressurization chamber 12. When a reach of the melt surface in the pressurization chamber 12 to the specified melt surface level S is detected by the level sensor 29, the cutoff valve 27 goes down, causing the melt flow passage 25 to be closed. From this on, the casting work is carried out similarly.

As described above, at the inner walls W of the pressurization chamber 12*a* and the outlet section 12*b*, the lining members 38, 39 which are formed of cylindrical-shaped integral burned products of fine ceramics (e.g., silicon nitride) are respectively provided so as to cover the wall surfaces. As a result, cracks and damage of the inner wall surfaces due to permeation of the molten metal are prevented, so that damage of the inner wall surfaces during the removal work of impurities deposited on the inner wall surfaces can be reduced and the durability of the inner wall surfaces can be improved. Further, in the pressurization section 12*a*, leakage of the pressurization gas can be prevented, so that the accuracy for pressure control by the pressurization gas can be improved. Moreover, as a result of the avoidance of permeation of the molten metal into the inner wall surfaces as well as cracks and damage of the inner wall surfaces in the outlet section 12*b*, it becomes implementable to securely charge a constant quantity of molten metal into the cavity 37, so that successful casting products can be manufactured. Further, when the lining members 38, 39 are given by an integral burned product formed of silicon nitride, which is superior particularly in high-temperature strength, high-temperature wear resistance and thermal shock resistance among cylindrical-shaped fine ceramics, it becomes achievable to further improve the durability of the inner wall surfaces of the pressurization section 12*a* and the outlet section 12*b*. Furthermore, when the valve seat 16, which is an integral burned product made of silicon nitride, is provided at the valve seat placement portion 15 of the melt flow passage 25, its durability can be improved as in the foregoing case. Besides, when the valve seat 16 is so provided that its upper end face becomes higher in position than the hearth face of the surrounding holding chamber 11, inflow of deposits within the holding chamber 11 into the pressurization chamber 12 can be suppressed, making it possible to inhibit contaminations of the molten metal in the pressurization chamber 12 to the least.

In the molten metal holding furnace 4 of the fourth embodiment, at the inner walls W of both the pressurization section 12*a* and the outlet section 12*b* are provided the lining members 38, 39 which are formed of cylindrical-shaped integral burned products of fine ceramics. However, a cylindrical-shaped integral burned product formed of fine ceramics may be provided at the inner wall surface W of only either one of the pressurization section 12*a* and the outlet section 12*b*.

Although the present invention has been fully described by way of examples thereof with reference to the accompanying drawings, it is to be noted that various changes and modifications are apparent to those skilled in the art. Such changes and modifications are to be understood as included within the scope of the present invention as defined by the appended claims unless they depart therefrom.

The molten metal holding furnace according to the present invention is suitable for manufacture of castings made of nonferrous metal such as aluminum and aluminum.

What is claimed is:

1. A molten metal holding furnace for supplying a constant quantity of molten metal to a casting machine, comprising:

a holding chamber having a melt supply port and a hearth face; and a pressurization chamber having an upward melt outlet port and a hearth, the holding chamber and the pressurization chamber being in communication with each other via an openable/closable first melt flow passage, wherein the pressurization chamber includes an outlet section with a first side and a second side, the upward melt outlet port being disposed on the first side and a pressurization section being disposed on the second side, the second side being closer to the holding chamber than the first side, the pressurization section including an upper space and a level detection unit configured to detect an upper-limit level and a lower-limit level of molten metal in the pressurization section, and a gas flow passage which is in communication with the upper space within the pressurization section, wherein first and second tube heaters are disposed in the holding chamber and the outlet section of the pressurization chamber, respectively, the first and second tube heaters being immersed in molten metal, wherein the holding chamber and the outlet section are juxtaposed with the pressurization section interposed therebetween so as to be partitioned by a partition wall which is disposed at a lower portion of the molten metal holding furnace and an upper end face of the partition wall forming a central hearth of the pressurization section at a position higher than the hearth face of the holding chamber, where the first melt flow passage is disposed at the hearth of the pressurization section, and an openable/closable second melt flow passage in communication with the outlet section is formed at the hearth of the pressurization section, and wherein the molten metal in the holding chamber is introduced to the upper-limit level of the pressurization section via the first melt flow passage under a condition that the second melt flow passage is closed, thereafter a pressurization gas is supplied through the gas flow passage under conditions that the first melt flow passage is closed and that the second melt flow passage is opened, so that the molten metal in the pressurization section is lowered to the lower-limit level of the pressurization section.

2. The molten metal holding furnace as claimed in claim 1, wherein the tube heaters are disposed in the molten metal within the pressurization section and are immersed therein.

3. The molten metal holding furnace as claimed in claim 1, wherein in the process of introducing the molten metal within the holding chamber to the upper-limit level of the pressurization section, the upper space of the pressurization section is reduced in pressure by evacuation via the gas flow passage under a condition that the second melt flow passage is closed.

4. The molten metal holding furnace as claimed in claim 1, wherein a lining member formed of a cylindrical-shaped integral burned product made of fine ceramics is disposed so as to cover an inner wall or inner walls of the pressurization section and/or the melt outlet port which is or are formed of a castable refractory.

* * * * *

UNITED STATES PATENT AND TRADEMARK OFFICE

CERTIFICATE OF CORRECTION

PATENT NO. : 7,790,098 B2
APPLICATION NO. : 11/791534
DATED : September 7, 2010
INVENTOR(S) : Shunji Mochizuki et al.

It is certified that error appears in the above-identified patent and that said Letters Patent is hereby corrected as shown below:

Title Page item 75
The first named inventor's name should read --Shunji MOCHIZUKI--.

Signed and Sealed this

Ninth Day of November, 2010

David J. Kappos

David J. Kappos
*Director of the United States Patent and Trademark Office*